United States Patent [19]

Tidman

[11] Patent Number: 5,012,720

[45] Date of Patent: May 7, 1991

[54] PLASMA PROJECTILE ACCELERATOR WITH VALVE MEANS FOR PREVENTING THE BACKWARD FLOW OF PLASMA IN PASSAGE THROUGH WHICH PROJECTILE IS ACCELERATED

[75] Inventor: Derek A. Tidman, Falls Church, Va.

[73] Assignee: GT-Devices, Alexandria, Va.

[21] Appl. No.: 400,291

[22] Filed: Aug. 29, 1989

[51] Int. Cl.[5] ..... F41B 6/00

[52] U.S. Cl. ..... 89/8; 89/31

[58] Field of Search ..... 89/7, 8, 31

[56] References Cited

U.S. PATENT DOCUMENTS

| | | | |
|---|---|---|---|
| 1,290,596 | 1/1919 | Lewis | 89/7 |
| 2,783,684 | 3/1957 | Yoler | 89/7 |
| 2,790,354 | 4/1957 | Yoler | 89/8 |
| 3,056,336 | 10/1962 | Tailer | 89/8 |
| 3,465,638 | 9/1969 | Canning | 89/8 |
| 4,590,842 | 5/1986 | Goldstein et al. | 89/8 |
| 4,715,261 | 12/1987 | Goldstein et al. | 89/8 |
| 4,757,740 | 7/1988 | McFarland | 89/7 |

FOREIGN PATENT DOCUMENTS

| | | | |
|---|---|---|---|
| 248340 | 12/1987 | European Pat. Off. | 89/8 |

OTHER PUBLICATIONS

S. I. Braginskii, pp. 214–217, *Reviews of Plasma Physics*, ed. by M. A. Leontovich, Consultants Bureau, New York, 1965.

S. Foner and E. Bobrov, "Multilayer Wire-Bound Pulsed Magnets: A New Look with New Materials", p. 31, *Megagauss Technology and Pulsed Power Applications*, ed. by Fowler et al., Plenum Press, New York and London.

*Primary Examiner*—Stephen C. Bentley

*Attorney, Agent, or Firm*—Lowe, Price, LeBlanc, Becker & Shur

[57] ABSTRACT

A projectile is accelerated in a bore of a barrel by applying a plasma to the bore behind the projectile. The plasma has a tendency to occupy a volume in the bore behind a location in the bore where the plasma is applied. A magnetic field is applied to the plasma synchronously with application of the plasma to the bore for substantially preventing the plasma from flowing into the bore volume behind the location.

25 Claims, 3 Drawing Sheets

PLASMA PROJECTILE ACCELERATOR WITH VALVE MEANS FOR PREVENTING THE BACKWARD FLOW OF PLASMA IN PASSAGE THROUGH WHICH PROJECTILE IS ACCELERATED

FIELD OF INVENTION

The present invention relates generally to plasmas for accelerating projectiles and more particularly to an apparatus for and method of accelerating a projectile in a bore of a barrel by applying a plasma behind the projectile, wherein a tendency of the plasma to occupy a volume in the bore substantially behind the projectile is substantially obviated by activating a valve synchronously with the application of the plasma to the bore, in the vicinity of the place where the plasma is applied to the bore.

BACKGROUND ART

Yoler, U.S. Pat. No. 2,783,684 and Yoler et al, U.S. Pat. No. 2,790,354 disclose high pressure, high temperature plasmas that are applied to a rear face of a projectile in a barrel bore, to accelerate the projectile in the bore. The plasma applied to the bore behind the projectile is derived by applying discharge voltages to a solid hydrocarbon tube located along the length of a barrel forming the bore. A series of such tubes is longitudinally disposed along the length of the barrel. The projectile is accelerated along the length of the barrel by providing discharge voltages along each tube in synchronism with movement of the projectile along the length of the bore. A discharge voltage is applied to each tube immediately after the projectile has traversed that particular tube. The plasma discharges establish a very high pressure behind the projectile to provide the driving force for the projectile.

Goldstein et al, U.S. Pat. No. 4,590,842, discloses a further system wherein a projectile is accelerated by applying plasma to a barrel bore through which the projectile is accelerated. The plasma is applied at plural longitudinal positions along the length of the bore by plural plasma sources positioned at an oblique angle with respect to the bore longitudinal axis. Each plasma source includes an elongated, capillary sleeve having a dielectric wall from which plasma is formed by an ablation process in response to a discharge voltage applied between spaced electrodes of the capillary passage. A capillary passage is a passage having a length to diameter ratio of at least 10:1. The plasma from each of the capillary sources having an oblique angle with respect to the barrel bore is applied to the rear of the projectile, to accelerate the projectile to a high velocity, such as a few kilometers per second. A capillary discharge can also be used to initiate movement of the projectile, by locating the capillary passage so it is coaxial with the barrel bore, as disclosed in U.S. Pat. No. 4,715,261.

In the copending, commonly assigned, Tidman et al U.S. Pat. application Ser. No. 06/929,365 filed Nov. 12, 1986, entitled "Apparatus For and Method of Accelerating A Projectile Through A Capillary Passage and Projectile Therefor," now U.S. Pat. No. 4,907,487 a projectile is initially accelerated by applying a discharge to a fluid substance in a capillary passage to form a plasma. A discharge is then established between electrodes at opposite ends of the capillary passage to further accelerate the projectile. Additional energy is imparted to the plasma at a position downstream of the initial starting location by ohmically heating the plasma as it traverses this location. The ohmic heating is obtained by applying eddy currents to the plasma with a solenoid coil surrounding the bore through which the projectile is accelerated.

A problem with devices of the type disclosed by Yoler et al and Yoler, and to a certain extent the other, previously described multi-stage projectile accelerators, is that the plasma applied to an intermediate location along the length of the barrel bore has a tendency to flow into the region of the bore substantially behind the projectile, i.e., into the volume of the bore between the projectile and the breech of the barrel. Because the plasma expands into the volume behind the projectile, the pressure exerted against the rear of the projectile is not as great as if the plasma were confined between the intermediate location and the rear of the projectile.

It is, accordingly, an object of the present invention to provide a new and improved apparatus for and method of accelerating a projectile by applying a high pressure plasma to the rear of the projectile as it is accelerated in a bore of a barrel, wherein the tendency of the plasma to expand into the volume of the bore behind the projectile is substantially overcome.

Another object of the present invention is to provide a new and improved apparatus for and method of activating a valve synchronously with the application of a plasma to a projectile that is accelerated in a barrel bore by the plasma to prevent the expansion of plasma to a volume behind the region where the plasma is applied to the projectile.

Another object of the invention is to provide an apparatus for and method of substantially preventing plasma that is applied to a bore of a barrel to accelerate a projectile in the barrel from flowing between an application region of the plasma to a volume behind the application region, with a valve means having no moving parts.

The importance of a valve means having no moving parts to prevent the expansion of plasma into a volume behind the projectile is paramount because of the very high speed, for example on the order of kilometers per second, of the projectile and the associated high sound speed of the main constituent, preferably hydrogen, of the plasma. There are obvious difficulties associated with physically moving a valve into position to prevent the expansion of the plasma for projectiles and gases having the stated speed magnitude.

In the copending, commonly assigned application of Goldstein et al, U.S. Pat. application Ser. No. 07/252,551, filed Oct. 3, 1988, entitled "Plasma Propulsion Apparatus and Method," substantially constant pressure is provided for a plasma accelerating a projectile along a barrel bore by linearly increasing the power supplied to a single capillary plasma discharge at one end of the bore. While this technique functions admirably, it requires a specialized, programmed power supply and relatively large peak currents as the projectile approaches the barrel muzzle.

It is, accordingly, a further object of the present invention to provide a new and improved apparatus for and method of accelerating a projectile in a barrel bore, wherein the pressure of the plasma is maintained at a high average value as the projectile traverses the bore through the use of a conventional power supply.

A further possible problem with the prior art devices is that the pressure in the bore can exceed the rupture pressure of a solid dielectric sleeve lining the barrel bore.

It is, accordingly, a further object of the present invention to provide a new and improved apparatus for and method of accelerating a projectile in a barrel bore, wherein the pressure of the plasma is automatically regulated so it cannot exceed a predetermined value that is likely to cause rupture of a component of the barrel bore.

DISCLOSURE OF THE INVENTION

In accordance with one aspect of the invention, a projectile is accelerated in a bore of a barrel by applying a plasma to the bore behind the projectile to accelerate the projectile in the bore. The plasma is introduced into the bore at a location where it has a tendency to occupy or expand into a volume behind the location where it is introduced. A valve means is activated synchronously with application of the plasma to the projectile for substantially preventing the plasma from flowing from said location into said volume. Thereby, the pressure of the plasma acting on the projectile is maintained at a high average value as the projectile is accelerated along the barrel bore, to increase the velocity of the projectile as it is continuously accelerated through the barrel bore.

In the preferred embodiment, the valve means for substantially preventing the plasma from flowing from said location into said volume comprises a magnetic field having a component at right angles to and in the plasma flow in the vicinity of said location. The magnetic field is formed by supplying a solenoid coil, wrapped coaxially around the bore, with a current having sufficient amplitude to form a magnetic mirror field having an intensity that interacts with the current in the plasma to prevent the flow of the plasma into said volume. Alternatively, the field can be established by coils having an axis at right angles to the plasma flow. The coil is preferably located immediately behind an electrode that is connected to one terminal of a power supply having a second terminal connected to another electrode longitudinally spaced downstream of the first named electrode.

The electrodes are preferably part of a capillary plasma source of the type disclosed in U.S. Pat. Nos. 4,590,842 and 4,715,261 and in the aforementioned applications. As such, a dielectric material subsists along the length of the barrel bore to form a wall of the bore. The dielectric material preferably is a solid hydrocarbon, such as polyethylene or polycarbonate, that is ablated and ionized in response to a discharge voltage from the power supply being applied across the electrodes to provide a plasma having a pressure of least 1,000 atmospheres and a temperature sufficiently high that atomic ionization of the dielectric has occurred.

In one embodiment of the invention the barrel breech is mechanically closed and the plasma is applied to the projectile at a location between the barrel breech and muzzle. The magnetic mirror field is applied to the bore region immediately upstream of where the plasma is derived to prevent expansion of the plasma from the bore region where the plasma is derived to the closed breech end. In accordance with a second embodiment, the barrel breech is mechanically open to receive the projectile from an appropriate starter stage. The plasma is applied behind the projectile very soon after the projectile has traversed the open breech. To prevent flow of the plasma out of the open breech a magnetic field with a radial component is applied to the open breech shortly before or simultaneously with the plasma discharge being initiated.

A main feature of the invention is that the plasma cannot substantially expand into the bore region upstream of where the plasma is applied. An auxiliary feature is that the magnetic field can be designed to limit the plasma pressure in the bore to a value less than the rupture pressure of the barrel bore materials. In response to the plasma pressure exceeding the pressure that can be confined by the magnetic field, some of the plasma expands through the magnetic field into the portion of the bore upstream of where the plasma was applied, to prevent rupture of the barrel bore materials. Because the plasma pressure cannot drop below the pressure that can be confined by the magnetic field, high pressure plasma continues to be applied to the rear of the projectile to accelerate the projectile to very high velocity in the bore.

The above and still further objects, features and advantages of the present invention will become apparent upon consideration of the following detailed description of several specific embodiments thereof, especially when taken in conjunction with the accompanying drawings.

DESCRIPTION OF THE PREFERRED EMBODIMENT

Figure 1:
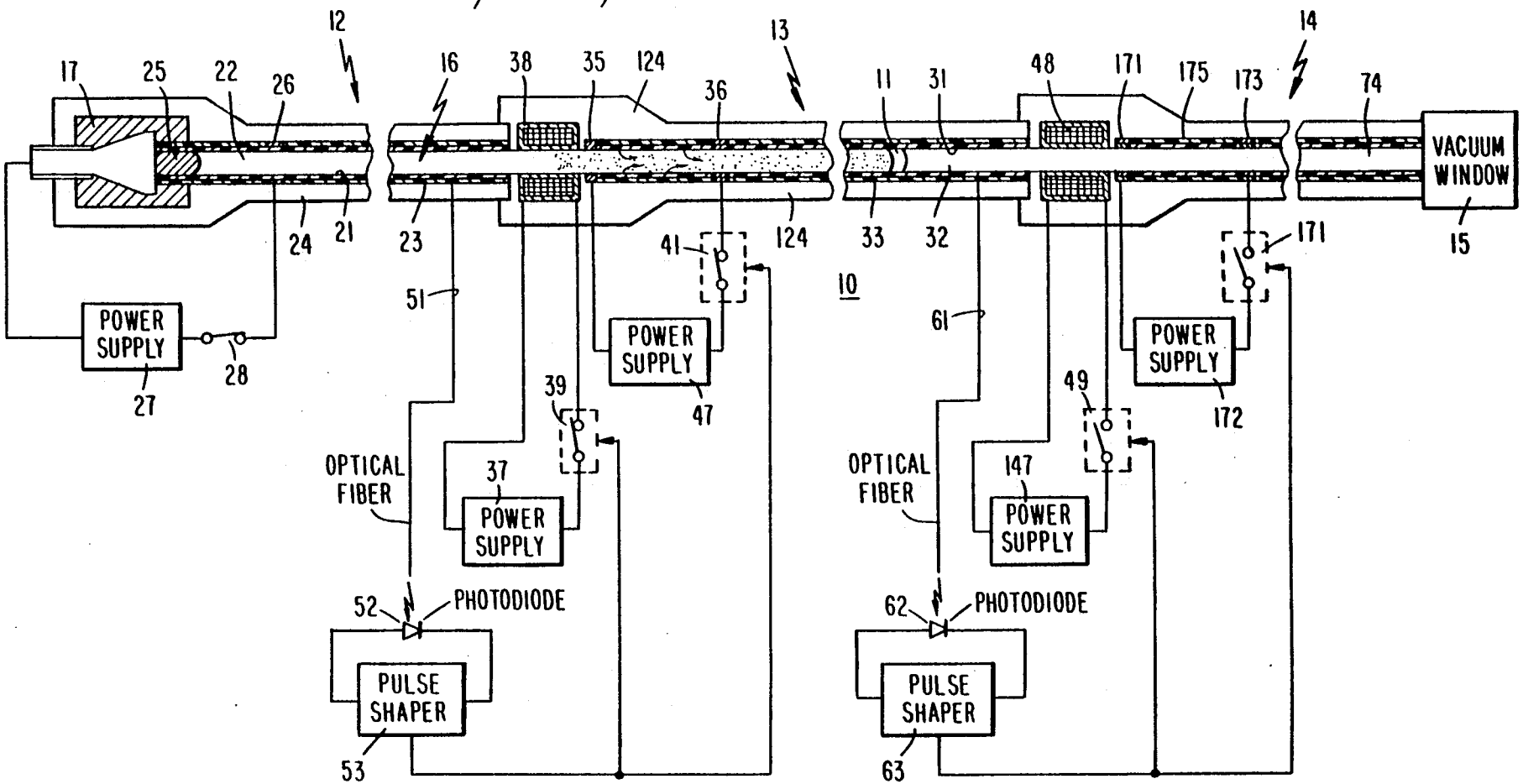
FIG. 1 is a cross-sectional view of a preferred embodiment of the invention, in combination with power supplies for activating the projectile accelerator.

Reference is now made to the FIG. 1 wherein gun 10 for accelerating projectile 11 is illustrated as including three cascaded capillary plasma generating stages 12, 13 and 14. Each of stages 12–14 has a common bore 16, preferably maintained at a vacuum. At muzzle 18, at the outlet of stage 14, vacuum window 15 is provided. Initially, projectile 11 is located on a shoulder (not shown) in stage 12 immediately downstream of electrode 25. High pressure plasma gas, having a pressure of at least about 1,000 atmospheres, developed in the bore of stage 12 behind projectile 11, accelerates the projectile from the initial rest position so that the projectile begins to move from left to right, as illustrated in FIG. 1, toward the outlet side of stage 13. When projectile 11 has moved through a portion of stage 13, so that it is downstream of electrode 36 additional plasma is formed in stage 13 to further accelerate the projectile through the remainder of stage 13 and into stage 14. Additional plasma is developed in stage 14 to further accelerate the projectile through the bore of stage 14.

Synchronously with movement of projectile 11 through stages 13 and 14 and with activation of plasma in stages 13 and 14 and application of that plasma to the rear of the projectile, a valve means is activated to substantially prevent the expansion of the plasma back toward breech block 17 of gun 10. The valve means, basically located at the inlet of each of stages 13 and 14, is a magnetic field having components at right angles to the plasma flow direction which is basically along the axis of bore 16. The magnetic field has sufficient intensity to substantially prevent the plasma from expanding into the volume of bore 16 between the location of the magnetic mirror field and breech 17. These magnetic field components interact within the plasma flowing at right angles to the field direction to prevent a substantial flow of the plasma through the magnetic field toward breech 17. Thereby, the plasma is forced against the rear face of projectile 11, to accelerate the projectile toward muzzle 18 at the end of barrel portion 15 with greater speed than if the magnetic field had not been applied. The effective volume through which the plasma gas works against the rear face of projectile 11 does not increase as the projectile is accelerated along bore 16 to nearly the same extent as if the plasma freely expands toward breech block 17. Accordingly, the pressure acting against the rear face of projectile 11 does not decrease rapidly as the projectile is accelerated, but is maintained at a high average level in response to application of additional plasma by downstream stages 13 and 14 to the rear face of the projectile. A typical velocity for projectile 11 at gun muzzle 18 at the outlet of stage 14 is on the order of kilometers per second.

Stage 12 at breech block 17 of gun 10 includes elongated dielectric sleeve 21, preferably fabricated of hydrocarbons such as polyethylene or polycarbonate. Sleeve 21 includes capillary passage 22, i.e., a passage having a length to diameter ratio of at least 10:1, through which projectile 11 is accelerated such that the projectile side wall contacts the wall of passage 22. The exterior wall of sleeve 21 abuts, throughout its entire length, against the inner wall of high strength dielectric liner tube 23, preferably as described in U.S. Pat. No. 4,715,261. Liner tube 23 has an exterior wall that abuts against the interior wall of steel tube 24 that effectively extends along the lengths of sections 12–14. At opposite ends of a capillary plasma discharge of stage 12 are metal electrodes 25 and 26, selectively connected by normally open switch 28 to high energy, relatively high voltage DC power supply 27. Electrode 25 blocks the end of capillary passage 22 where muzzle 18 is located, while electrode 26 is formed as a ring on the wall of the capillary passage, in sleeve 21 and liner 23 at a position about one-quarter of the way between the end of electrode 25 and the open end of stage 12 that abuts against stage 13. Electrode 26 is immediately behind the initial position of projectile 11. Electrode 25 is insulated from steel tube 24 as shown in U.S. Pat. No. 4,715,261.

In response to switch 28 being closed, a capillary discharge is established in passage 22 across electrodes 25 and 26 by power supply 27, having a voltage of at least 10 kilovolts and at least 3 kilojoules of energy, for delivering a current of 10–50 kiloamperes to the electrodes. The discharge causes a high pressure (at least 1,000 atmospheres), high temperature plasma (considerably more than 3,000° Kelvin) to be formed in passage 22. Because of the characteristics of power supply 27 and the capillary geometry of passage 22, the high pressure, high temperature plasma fills passage 22. The discharge subsists for between approximately 100 to 1,000 microseconds during which time material is ablated from the interior wall of sleeve 21, to become ionized and form the plasma. The discharge occurs along the wall of sleeve 21, to ablate hydrogen primarily and some carbon from the hydrocarbon of sleeve 21. To achieve projectile speeds on the order of approximately 10 kilometers per second, the working plasma is preferably dissociated ionized polyethylene which is optically thick, i.e., has a diameter many orders of magnitude larger than the optical absorption length and a temperature of several electron volts.

As a result of the high temperature, high pressure plasma in passage 22, additional material is ablated from the interior wall of sleeve 21 to form additional plasma. As described in Goldstein et al, U.S. Pat. No. 4,590,842, the additional hydrogen and carbon are ablated from the wall of sleeve 21 in response to current flowing between electrodes 25 and 26, causing ohmic dissipation in the plasma to transfer energy efficiently from power supply 27 into the plasma. Simultaneously, radiation emission and thermal conduction transport energy from the plasma in passage 22 to the materials in the wall of sleeve 21 to ablate additional material from the wall, causing additional plasma to be formed in the passage. Thereby, material in sleeve 21 is consumed as fuel and ejected as plasma from passage 22 into aligned passage 32 of stage 13 as projectile 11 is accelerated from its initial, illustrated rest position toward muzzle 18 of gun 10. Because of the position of electrode 26 along the length of stage 12 the plasma sound speed has slowed to approximately the speed of projectile 11 when the projectile exits stage 12 and enters stage 13.

Stage 13 adds additional energetic plasma and further excites the plasma flowing into it from stage 12 and includes a valve for preventing the flow, i.e., expansion of plasma, back toward breech block 17 via bore 16.

Stage 13 is constructed similarly to stage 12 in that stage 13 includes polycarbonate sleeve 31 and capillary passage 32, surrounded by dielectric tube 33, in turn surrounded by steel tube or jacket 124. Sleeve 31 and tube 33 are constructed almost identically with sleeve 21 and tube 23 and the two sets of tubes and sleeves are arranged so that passages 22 and 32 of stages 12 and 13 are aligned, to assist in forming bore 16 of gun 10. Ring electrodes 35 and 36, both identical to ring electrode 26, are respectively close to the inlet of stage 13 and about one-quarter of the way between the inlet and outlet of stage 13. Connected across electrodes 35 and 36 are high voltage, high energy power supply 47 and normally open switch 41. Power supply 47 establishes about the same voltage between electrodes 35 and 36 as is established by power supply 27 across electrodes 25 and 26; typically, power supplies 27 and 47 have the same energy ratings.

To detect the movement of projectile 11 through the outlet of stage 12, the outlet of the stage is provided with a motion detector including fiber optic element 51 which extends through jacket 24 so that the end of the element abuts against liner 33. Tube 31 and liner 33 are sufficiently transparent to the intense optical energy of the plasma in passage 16 to enable the plasma to couple detectable amounts of optical energy from the end of fiber optic element 51 abutting against liner 33 to photodiode 52 at the opposite end of the fiber optic element. Immediately after projectile 11 traverses the region of passage 32 where fiber optic element 51 is located, the optical energy in the plasma causes a change in the impedance state of photodiode 52. Photodiode 52 is connected to pulse shaper 53 which responds to the changed, lower impedance state of photodiode 52 to develop a pulse that occurs just after projectile 11 has passed electrode 36. The pulse from pulse shaper 53 closes switch 41 to cause high pressure, high temperature plasma to be developed in passage 32 in the same manner as high temperature, high pressure plasma is formed in passage 22.

When projectile 11 reaches electrode 36 in stage 13, the volume of bore 16 behind the projectile extends from electrode 25 at breech 17 to electrode 36. The plasma in passages 22 and 32 behind projectile 11 has a very high sound speed because of the very high percentage of hydrogen therein. The high sound speed and pressure of the plasma cause projectile 11 to be accelerated to very high speeds. However, the plasma in passages 22 and 32, has a tendency, after initially moving toward muzzle 18, to flow back toward breech 17. This tendency of the plasma to flow back toward breech 17 is overcome, in accordance with the present invention, by applying an energy field to the plasma at the vicinity of the capillary discharge of stage 13, particularly slightly upstream of electrode 35. The energy field is a magnetic mirror field pulse having components that interact with charged particles of the plasma. The magnetic field pulse interacts with the plasma to function in the manner of a valve, to substantially prevent the flow of plasma from passage 32 back into passage 22 and toward muzzle 17.

To generate the magnetic mirror field pulse, solenoid coil 38 is wound in jacket 124 about bore 16 just downstream of the outlet of stage 12, almost immediately upstream of electrode 35. Coil 38 is confined by faces in a cavity of jacket 124; the faces abut against opposite end faces and the circular periphery of the coil. Coil 38 preferably is wound of wire having a square cross section. Opposite ends of coil 38 are selectively connected to DC power supply 37 by way of switch 39, which is closed simultaneously with closure of switch 41 in response to the output of pulse shaper 53. The number of turns in coil 38 and the magnitude of the current supplied to the coil by DC power supply 37, when switch 39 is closed, are such that the fringing, curved magnetic field components produced by the coil in passage 32 interacts with the free charges in the plasma to prevent the substantial flow of plasma from electrode 35 of stage 13 into passage 22 of stage 12. Thereby, the effective volume of bore 16 occupied by the plasma is considerably reduced while switch 39 is closed and current is fed by supply 37 to coil 38. Switch 39 remains closed while projectile 11 traverses the distance from electrode 36 to a corresponding electrode 173 in stage 14. Since the amount of plasma between the region where the fringing field from coil 38 acts on the plasma in passage 32 and the back end, i.e., rear face, of projectile 11 includes a significant portion of the plasma from stage 13, as well as virtually all of the plasma from stage 12, the pressure exerted by the plasma on the rear face of projectile 11 is maintained at a high average value which may, in certain instances, increase over the pressure exerted by the plasma in stage 12.

The pressure of the magnetic mirror field produced by coil 38 on the plasma in passage 32 is less than the rupture pressure of sleeve 31, tube 33 and other components of stage 13. If the pressure developed by the plasma in passage 32 exceeds the magnetic mirror field pressure, some of the plasma flows through the magnetic field into passage 22. The plasma flow from passage 32 to passage 22 continues until the pressure in passage 32 drops slightly below the confining pressure of the magnetic field produced by coil 38. Hence, the magnetic mirror field is a leaky valve that prevents rupture of the components of stage 13.

The technology for providing solenoids for generating magnetic field pulses in the required pressure range and volume to prevent the backward flow of plasma to the portion of the bore behind the projectile or the open breech, is well established, as disclosed, for example, by Foner and Bobrov, *Megagauss Technology and Pulsed Power Applications,* edited by C.M. Fowler, R.S. Caird and D.J. Erickson, New York: Plenum Press 1987. p. 31.

The required strength of the magnetic field is about 40 Tesla, which produces a pressure of 6.3 kilobars. Typically, the stated field strength is obtained by providing a current pulse having a duration of approx 1 millisecond in a cylindrical volume of about $$\frac{\pi d^3}{2}$$

where d is the diameter of the bore. The solenoid coil is reusable for many shots, e.g., in excess of 100. The coil wire preferably has a square cross-section and is formed of copper or an alloy of neodymium and copper. The wire preferably has a square cross-section because square wire has a greater packing density than circular wire, to provide a more intense magnetic field. A thin insulation coating surrounds each wire, to provide tight packing and a precompressed hardened sealed containment structure. To reduce coil resistivity and ohmic heating in the coil, the coil may be cooled by being immersed in liquid nitrogen.

Coils of this type are most suitable for use with independent, dedicated power supplies because they usually require much lower currents than are used to derive the plasma discharge which forms the plasma between the electrodes. If, however, the solenoid coil is connected in series with the electrodes, the coil has far fewer turns to produce the required magnetic field because the current supplied to the plasma discharge is considerably greater than that required for a dedicated solenoid. In this case the coils have a heavier flat plate structure, for example in a Bitter coil arrangement as used for high current pulsed magnetic fields.

To enable the plasma pressure to be contained by the magnetic field established by the current flowing in each solenoid coil, the weighted average axial leakage diffusion speed of the plasma in the region of the magnetic field should be small compared with the projectile velocity, i.e., the axial plasma speed should be no more than one-fifth of the projectile velocity. A characteristic plasma diffusion speed due to coulomb collisions is:

$$v_{Diff} = \frac{c^2}{4\pi\sigma l_B} = \frac{4.2\ Z\log\Lambda}{l_B T_{eV}^{3/2}}\left(1 + \frac{2\nu_{eo}}{\nu_{ei}}\right)\text{km/sec}$$

where $l_B$ is the effective gradient scale of the magnetic field in the bore region of the magnetic field, $T_{eV}$ is the plasma temperature in electron-volts, Z is the charged state of ions in the plasma, assuming a single species of ions in the plasma, log λ is the coulomb screening logarithm (a term defined by S.I. Braginskii, *Reviews of Plasma Physics,* edited by M.A. Leontovich, New York: Consultants Bureau, 1965 p. 216) and $\nu_{ei}$ and $\nu_{eo}$ are respectively the electron-ion and electron-neutral angular scattering frequencies of the plasma. For example, this plasma diffusion speed is typically no more than one-fifth the plasma sound speed for plasma temperatures of 4 electron-volts and values of $l_B$ approximately 0.5 times the diameter of the bore and a bore diameter of at least 0.8 centimeters. The magnetic field more effectively blocks the plasma for high plasma temperatures and large bore diameters.

For the high pressure coulomb gas collision dominated plasma involved in this situation, turbulent diffusion would not enhance the diffusion rate significantly. Although a cool thermal sublayer adjacent the wall of passage 22 would escape somewhat rapidly across the magnetic field because such a sublayer has a relatively low electrical conductivity, such a layer has a thickness much less than the total radius of the plasma filling the bore, and therefore does not contribute a large leakage effect of the plasma across the magnetic field.

Stage 14 is constructed similarly to stage 13, to apply a high pressure, high temperature plasma to the rear face of projectile 11. When projectile 11 reaches the vicinity of the outlet of stage 13, a pulse is derived in the same manner as described for the pulse which is derived in the vicinity of the outlet of stage 12 by providing fiber optic element 61 and photo detector 62, which drives pulse shaper 63. Pulse shaper 63 derives a pulse to control switch 49 to cause current to be supplied by DC power supply 147 to solenoid 48 in the same manner that power supply 37 supplies current to solenoid 38 via switch 39. In addition shaper 63 supplies a pulse to switch 171, causing the switch to close and connect DC power supply 172 across electrodes 171 and 173 to provide a plasma discharge in passage 74 as a result of ablation from the wall of dielectric sleeve 175.

The number of stages is increased, as necessary, to achieve the desired velocity, e.g., 10 kilometers per second, for projectile 11 at muzzle 18.

In a multistage system of the type illustrated in FIG. 1, as the velocity of the projectile into a given stage increases, the power pulse time and input power applied to the electrodes of the stage must be shorter and greater, respectively, to accelerate the projectile with a given pressure. Hence, the duration and power of the electric pulses applied to the electrodes of stage 13 are respectively less than and greater than those of the pulses applied to the electrodes of stage 12. The product of the power and duration of each pulse is approximately the same so that about the same amount of energy is applied to each stage. The shorter pulse time and greater input power generate higher temperature plasma with the higher sound speed needed to fill the space between the breech and the projectile.

Figure 2:
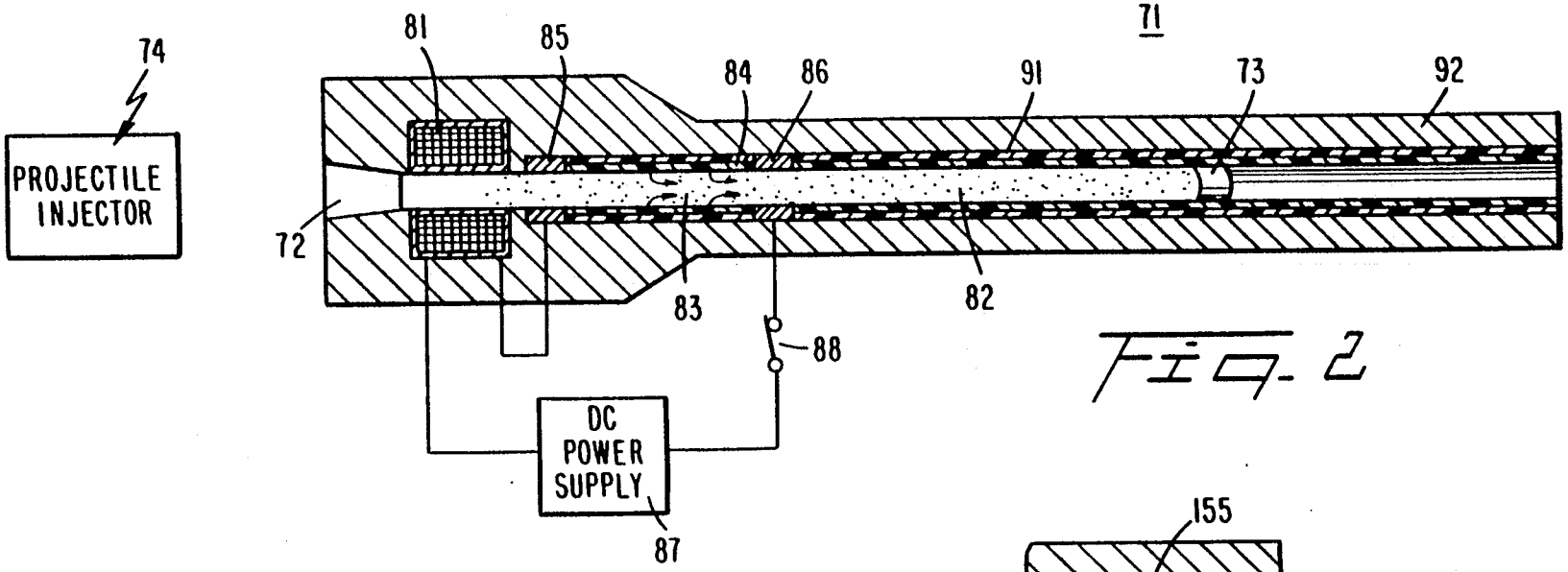
FIG. 2 is a diagram of a second embodiment of the invention wherein a projectile is injected into an open breech having a solenoid coil in proximity thereto for applying a magnetic mirror field to prevent the flow of plasma through the breech.

Reference is now made to FIG. 2 of the drawing, wherein there is illustrated a further embodiment of the invention. In the embodiment of FIG. 2, gun 71 includes open breech 72 through which projectile 73 is injected by injector 74 that can be any known mechanism, such as a gas gun, or a capillary, plasma source as disclosed in U.S. Pat. No. 4,715,261.

Positioned immediately downstream of open breech 72 is Bitter coil 81, wound coaxially with bore 82 of the barrel of gun 71. Positioned immediately downstream of coil 81 is capillary plasma source 83, preferably constructed identically to the capillary plasma sources of FIG. 1 to include hydrocarbon, dielectric sleeve 84, as well as electrodes 85 and 86. One end of solenoid coil 81 is connected to electrode 85. The series combination of coil 81 and electrode 85 is connected to one terminal of DC power supply 87, having another terminal connected via switch 88 to electrode 86. Switch 88 is closed in response to projectile 73 passing electrode 86, by the use of a detector, as described supra, or by preprogramming the switch closure time to be a predetermined time after initial launch of each projectile from injector 74.

The high pressure, high temperature plasma produced in the capillary discharge between electrodes 85 and 86 after projectile 73 has passed electrode 85 is prevented from escaping from breech 72 by the magnetic mirror field applied by coil 81 to bore 82 of gun 71. Thereby, the plasma is exerted against the rear face of projectile 73 to accelerate the projectile through bore 82.

Sleeve 84 abuts against dielectric, cylindrical liner 91, in turn surrounded by gun barrel 92 that confines coil 81. The barrel of gun 71 has a bore with a uniform diameter throughout the length of the bore by appropriately sizing electrodes 85–86, and abutting dielectric sleeve 93 against liner 91 between electrode 86 and the gun barrel muzzle.

An alternative configuration to that illustrated in FIG. 2 is to provide solenoid coil 81 with a power supply separate from the power supply for the capillary discharge connected between electrodes 85 and 86. In such a situation, the power supply for solenoid coil 81 delivers considerably less energy to the coil than the energy delivered by the capillary discharge power supply to electrodes 85 and 86. In such a configuration, the solenoid power is switched on first, immediately after projectile 73 has traversed the region where the solenoid is located. Then, immediately after projectile 73 has passed the downstream second electrode 86 for the plasma discharge, or simultaneously with the projectile passing the second electrode, the plasma discharge power supply is connected to electrodes 85 and 86. Thereby, a high pressure wall-confined plasma is established in a capillary discharge passage between electrodes 85 and 86. The high pressure plasma is also confined between the magnetic field established by solenoid coil 81 at breech 72 of the barrel and the base of projectile 73, to accelerate the projectile in barrel bore 82.

Soon after the discharge applied to electrodes 85 and 86 has been extinguished, the confining magnetic field established by solenoid coil 81 drops to zero. When the magnetic field from solenoid coil 81 drops to zero, a plasma rarification is propagated from open breech 72 toward the base of projectile 73. However, by the time this rarification reaches projectile 73, an efficient fraction of the plasma energy established by the discharge between electrodes 85 and 86 has been transferred to kinetic energy to accelerate the projectile and the confining magnetic field closure at open breech 72 has performed the function thereof.

A magnetic breech closure device, as illustrated in FIG. 2, has the advantage that a projectile can be injected with high velocity through open breech 72 into electrothermal gun 71 which produces a plasma between electrodes 85 and 86. The apparatus of FIG. 2 can be modified to include plural stages, as illustrated in FIG. 1 by stages 13–15.

Figure 3:
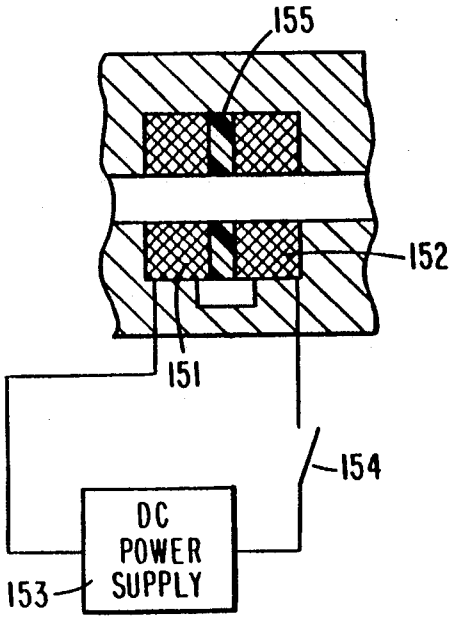
FIG. 3 is a schematic drawing of a modified coil arrangement.

If necessary, additional magnetic field strength can be provided in the vicinity of each coil by using two or more coils having currents flowing in opposite directions to provide a few cusps in a picket fence arrangement. Such an arrangement is illustrated in FIG. 3, wherein solenoid coils 151 and 152 are arranged so that coil 151 is upstream of coil 152 with dielectric spacer 155 between adjacent end faces thereof. Coils 151 and 152 are connected in series with each other and to DC power supply 153 via switch 154. Coils 151 and 152 are connected to power supply 153 so that the currents flowing in coils 151 and 152 flow in opposite directions. The main magnetic solenoid field from coil 151 is thereby directed axially of the bore toward the muzzle, while the main magnetic solenoid field resulting from coil 152 is directed axially of the bore away from the muzzle. The curved components of two magnetic fields from coils 151 and 152 interact to substantially prevent the flow of plasma through them, with a cusp being produced in the vicinity of spacer 155. While the solenoid coils illustrated in FIGS. 1 and 3 are preferable for mechanical stability and strength, greater efficiency is attained by using coils having axes at right angles to the axis of bore 16.

At velocities on the order of 10 kilometers per second and less, projectile 11 may be allowed to contact the side wall of capillary passage 22. For higher velocities, projectile 11 is preferably in free flight, i.e., there is a slight spacing between the projectile side wall and the wall of capillary passage 22. Free flight at these velocities is important to avoid violent gouging collisions between projectile 11 and wall roughness protrusions, referred to as asperities.

Typically free flight would be necessary at stages downstream of stage 14 of the device illustrated in FIG. 1. In free flight, the plasma has a tendency to flow around the periphery and to the front of the projectile. This plasma in front of the projectile may slow the projectile as described in U.S. Pat. NO. 4,590,842. The plasma leaking in front of the projectile may be vented to a region outside of the gun confines. Another solution to the problem which is particularly suited to the use of the magnetic field valve is illustrated in FIG. 4.

Figure 4:
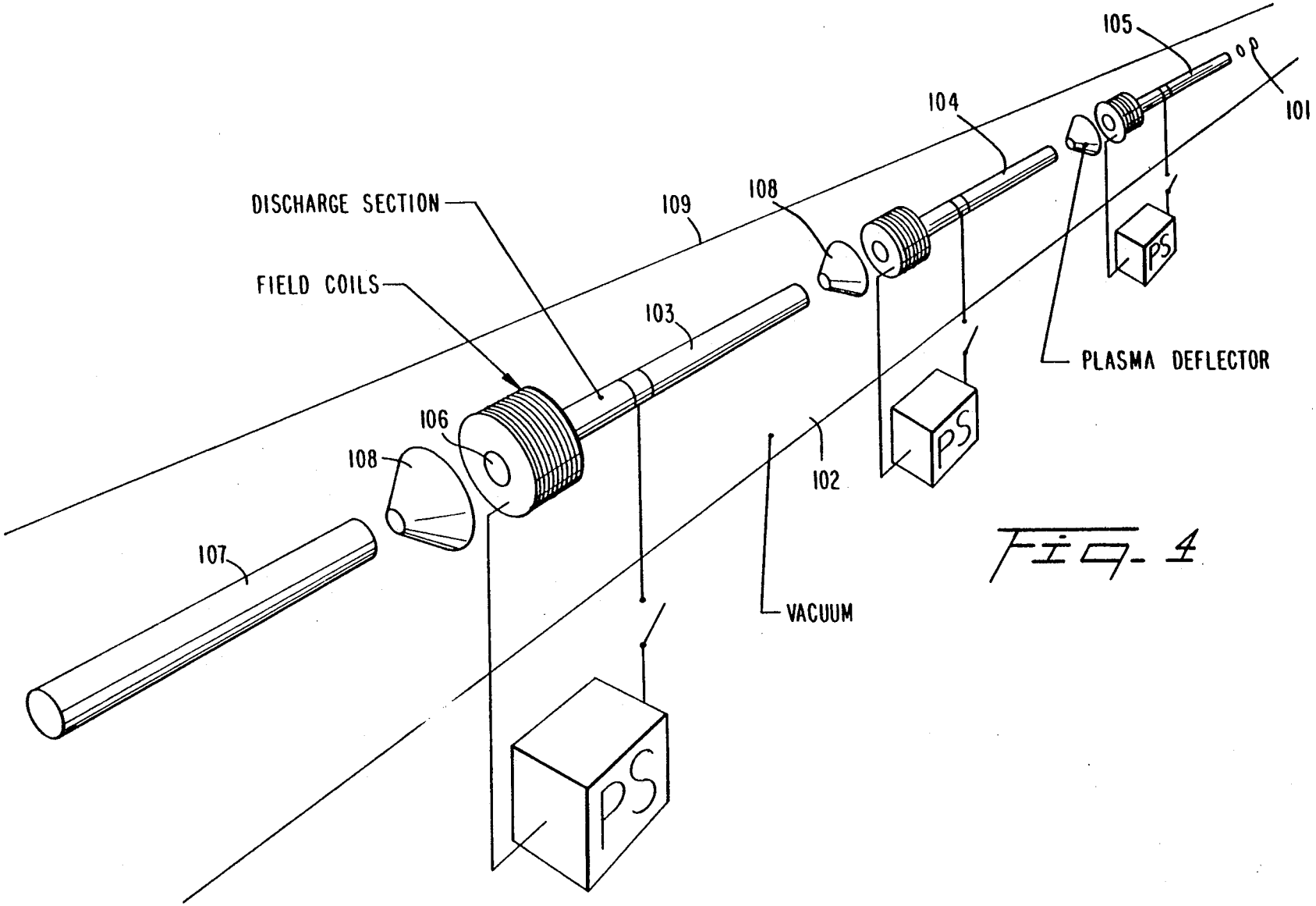
FIG. 4 is a schematic, perspective drawing of a third embodiment of the invention wherein a projectile is in free flight.

In FIG. 4, projectile 101 is illustrated in free flight after having been accelerated in elongated vacuum chamber 102 by cascaded stages 103–105, each of which is constructed in substantially the same manner as illustrated in FIG. 2. Stage 103 has inlet 106 for receiving projectile 101 after the projectile has been accelerated to a speed of about 10 kilometers per second by a projectile-wall contact device 107, e.g., as illustrated in FIG. 1. In the apparatus of FIG. 4 a separate frustroconical plasma deflector 108 having an on-axis aperture through which projectile 101 passes is positioned between the outlet of device 107 and inlet 106 of stage 103, between the outlets and inlets of stages 103, 104 and 105 and downstream of the outlet of stage 105.

Deflectors 108 are positioned and sized so that virtually all of the high pressure plasma flowing from the outlet of the immediately preceding upstream device or stage is deflected off of the projectile flow path. Thereby the plasma that has flowed around and in front of free flight projectile 111 does not impede the projectile movement. Because the plasma sound speed and the projectile speed are about the same when the projectile reaches each deflector, the plasma that remains behind the projectile does not contribute any additional accelerating force at this time. Because deflectors 108 must have sufficient strength and high temperature stability to withstand the plasma pressure and temperature, they are preferably formed of steel coated with a ceramic. Because the small bases of deflectors 108, through which projectile 101 initially passes, are proximate the outlets of stages 103–105 and device 107, the expanding plasma flowing from stages 103–105 and device 107 is indicent on the sloping side walls of the deflectors. The plasma incident on the side walls of deflectors 108 is reflected from the deflectors toward exterior wall 109 of chamber 102. Thereby the plasma is prevented from flowing into the downstream stages and does not appreciably interfere with the free flight of projectile 101.

While there have been described and illustrated several specific embodiments of the invention, it will be clear that variations in the details of the embodiments specifically illustrated and described may be made without departing from the true spirit and scope of the invention as defined in the appended claims.

I claim:

1. A projectile accelerator comprising an elongated wall having an interior passage through which the projectile is accelerated, said wall including a pair of electrodes longitudinally spaced in the direction of projectile acceleration, a mass of ionizable material between said electrodes, said mass of material being ionized in response to a discharge voltage being applied to said electrodes to produce a plasma having sufficiently high pressure in said passage behind the projectile to accelerate the projectile, and valve means activated synchronously with the derivation of the high pressure plasma for preventing the flow of the plasma to a portion of the passage behind the electrodes after the plasma has been established between the electrodes, said valve means including means for applying a magnetic field to plasma in said portion of the region.

2. The projectile accelerator of claim 1 wherein said magnetic field exerts a pressure on the plasma less than the minimum rupture pressure of any components in the wall between said electrodes.

3. The projectile accelerator of claim 1 wherein the magnetic field applying means includes means for establishing a magnetic field with a component at right angles to the direction of plasma flow in the passage.

4. The projectile accelerator of claim 3 wherein the magnetic field establishing means includes a solenoid coil in said wall.

5. The projectile accelerator of claim 4 further including first and second separate power supplies, said first power supply being selectively energized to supply the discharge voltage across the electrodes, the second power supply being selectively energized to supply current to said coil.

6. The projectile accelerator of claim 3 wherein the magnetic field establishing means includes a pair of solenoid coils in said wall, said solenoid coils being arranged so that each produces a main magnetic solenoid field directed axially of said passage, the coils being wound and positioned and the current flowing in the coils being such that the main axial magnetic fields of the first and second coils are oppositely directed and curved components of the fields have overlapping regions completely across the passage interior.

7. The projectile accelerator of claim 1 wherein the electrodes are located along the wall at an intermediate position between a breech of a gun barrel including the elongated wall and a muzzle of the gun barrel, said valve means being located immediately upstream of one of said electrodes, said one electrode being closer to a breech of said gun barrel than the other of said electrodes.

8. The projectile accelerator of claim 7 wherein the breech is mechanically closed while the discharge voltage is applied between the electrodes.

9. A projectile accelerator comprising an elongated wall having an interior passage through which the projectile is accelerated, said wall including a pair of electrodes longitudinally spaced in the direction of projectile acceleration, a mass of ionizable material between said electrodes, said mass of material being ionized in response to a discharge voltage being applied to said electrodes to produce a plasma having sufficiently high pressure in said passage behind the projectile to accelerate the projectile, and valve means activated synchronously with the derivation of the high pressure plasma for preventing the flow of the plasma to a portion of the passage behind the electrodes after the plasma has been established between the electrodes said wall being in a gun barrel having an area through which the projectile is accelerated into the interior passage, said valve means being located in the immediate vicinity of said area, one of said electrodes being located immediately downstream of the area and the location where the valve means is located, said valve means including means for applying a magnetic field to plasma in said portion of the region.

10. A projectile accelerator comprising an elongated wall having an interior passage through which the projectile is accelerated, means for supplying a high pressure plasma to a region of the passage behind the projectile to accelerate the projectile axially in the passage, and valve means activated synchronously with the application of the plasma to said region of the passage for substantially preventing the flow of said plasma into a portion of the passage behind said region, said valve means including means for applying a magnetic field to plasma in said region.

11. The projectile accelerator of claim 10 wherein the magnetic field applying means includes means for establishing a magnetic field with a component at right angles of plasma flow in the passage.

12. The projectile accelerator of claim 11 wherein the magnetic field establishing means includes a solenoid coil in said wall.

13. The projectile accelerator of claim 10 wherein said wall is in a gun barrel having an area through which the projectile is accelerated into the interior passage, said valve means being located in the immediate vicinity of said area.

14. The projectile accelerator of claim 10 wherein said region is at an intermediate position between a breech of a gun barrel including the elongated wall and a muzzle of the gun barrel, said valve means being located immediately upstream of said region.

15. The projectile accelerator of claim 10 wherein said magnetic field exerts a pressure on the plasma less than the minimum rupture pressure of any components in the wall at said region.

16. The projectile accelerator of claim 10 wherein said magnetic field exerts a pressure on the plasma less than the minimum rupture pressure of any components in the wall at said region.

17. The projectile accelerator of claim 10 wherein said region is at an intermediate position between a breech of a gun barrel including the elongated wall and a muzzle of the gun barrel, said valve means being located immediately upstream of said region proximate a breech of said gun barrel.

18. The projectile accelerator of claim 17 wherein the magnetic field applying means includes a solenoid coil in said wall.

19. The projectile accelerator of claim 18 wherein said wall is in a gun barrel having an area through which the projectile is accelerated into the interior passage, said magnetic field being applied to the plasma in the immediate vicinity of said area.

20. The projectile accelerator of claim 18 wherein the breech is mechanically closed while the plasma voltage is applied to said region.

21. The projectile accelerator of claim 17 wherein the magnetic field establishing means includes a pair of solenoid coils in said wall, said solenoid coils being arranged so that each produces a main magnetic solenoid field directed axially of said passage, the coils being wound and with axial and radial components positioned and the current flowing in the coils being such that the main axial magnetic fields of the first and second coils are oppositely directed and curved components of the fields have overlapping regions completely across the passage interior.

22. A projectile accelerator comprising an elongated wall having an interior passage through which the projectile is accelerated, means for supplying a high pressure plasma to a region of the passage behind the projectile to accelerate the projectile axially of the passage, and means for applying a force field to the plasma for preventing the flow of said plasma to a portion of the passage behind said region, the means for applying the force field including means for supplying behind said region a magnetic field with a component transverse to plasma flow in the passage.

23. The projectile accelerator of claim 22 wherein said magnetic field exerts a pressure on the plasma less than the minimum rupture pressure of any components in the wall at said region.

24. A method of accelerating a projectile in an elongated passage comprising supplying a high pressure plasma to a region of the passage behind the projectile to accelerate the projectile axially of the passage, and applying magnetic field to the plasma in the passage, the magnetic field having components positioned and with sufficient strength to exert sufficient pressure against the plasma to prevent the substantial flow of said plasma into a portion of the passage behind said region.

25. A method of accelerating a projectile in an elongated passage comprising supplying a high pressure plasma to a region of the passage behind the projectile to accelerate the projectile axially of the passage, and applying a force field to the plasma for preventing the flow of said plasma to a portion of the passage behind said region, the force field comprising a magnetic field applied to the passage behind said region.

* * * * *